US008161691B2

(12) United States Patent
Platt et al.

(10) Patent No.: US 8,161,691 B2
(45) Date of Patent: Apr. 24, 2012

(54) PRECAST COMPOSITE STRUCTURAL FLOOR SYSTEM

(75) Inventors: David H. Platt, West Jordan, UT (US); John E. Charchenko, West Bountiful, UT (US); Daryl G. Hodgson, Lehi, UT (US); Russell J. Platt, Holladay, UT (US)

(73) Assignee: Plattforms, Inc., Holladay, UT (US)

( * ) Notice: Subject to any disclaimer, the term of this patent is extended or adjusted under 35 U.S.C. 154(b) by 411 days.

(21) Appl. No.: 12/465,597

(22) Filed: May 13, 2009

(65) Prior Publication Data

US 2009/0288355 A1 Nov. 26, 2009

Related U.S. Application Data

(60) Provisional application No. 61/053,147, filed on May 14, 2008.

(51) Int. Cl.
*E04B 5/04* (2006.01)
*E04B 5/10* (2006.01)

(52) U.S. Cl. ..... 52/79.14; 52/236.6; 52/250; 52/251; 52/252; 52/281; 52/434; 52/414; 14/73; 14/74.5

(58) Field of Classification Search ..... 52/236.6, 52/236.8, 79.14, 333, 334, 414, 841, 250–252, 52/281, 434, 602, 332, 747.14; 14/73, 74.5
See application file for complete search history.

(56) References Cited

U.S. PATENT DOCUMENTS 644,940 A 3/1900 Orr
1,891,763 A 12/1932 Henderson
2,016,616 A * 10/1935 Schaub ..... 52/334
2,171,338 A * 8/1939 Henderson ..... 52/220.2
2,184,464 A * 12/1939 Myers ..... 52/284
2,294,554 A * 9/1942 Henderson ..... 52/236.3
2,297,952 A 10/1942 Friberg
2,423,695 A 7/1947 Falco
2,675,695 A 4/1954 Coff
2,987,855 A * 6/1961 Singleton et al. ..... 52/334
3,210,900 A * 10/1965 Sattler ..... 52/334
3,257,764 A * 6/1966 Cripe ..... 52/252
3,282,017 A * 11/1966 Rothermel ..... 52/745.19

(Continued)

FOREIGN PATENT DOCUMENTS

DE 3837774 C1 5/1990

(Continued)

OTHER PUBLICATIONS

International Search Report dated Jul. 30, 2010 from PCT Application No. PCT/US09/064451 filed Nov. 13, 2009 (4 pages).

(Continued)

*Primary Examiner* — Robert Canfield
(74) *Attorney, Agent, or Firm* — Bateman IP

(57) ABSTRACT

A precast composite flooring system utilizes girders and floor panels having steel lower structures placed in tension and concrete upper structures places in compression. Openings through a stem wall allow ducts, pipes, and conduits to be run therethrough. The system provides reduced weight over conventional precast or pour in place systems, allowing further reduction in the weight and size of other building components. The floor deck does not use tensioning strands, allowing openings to be formed at nearly any stage of construction and with reduced concern over cutting steel reinforcement. The floor panels and girders bolt together and bolt to a steel column frame, allowing for more efficient assembly.

22 Claims, 16 Drawing Sheets

U.S. PATENT DOCUMENTS

| | | | | | |
|---|---|---|---|---|---|
| 3,385,015 | A | * | 5/1968 | Hadley | 52/223.8 |
| 3,550,332 | A | * | 12/1970 | Wiesman | 52/28 |
| 3,567,816 | A | | 3/1971 | Embree | |
| RE29,249 | E | | 6/1977 | Rice | |
| 4,300,320 | A | | 11/1981 | Rooney | |
| 4,646,493 | A | * | 3/1987 | Grossman | 52/223.1 |
| 4,653,237 | A | * | 3/1987 | Taft | 52/335 |
| 4,912,794 | A | * | 4/1990 | Thivans | 14/3 |
| 4,972,537 | A | | 11/1990 | Slaw | |
| 4,991,248 | A | * | 2/1991 | Allen | 14/73 |
| 5,029,426 | A | | 7/1991 | Larson et al. | |
| 5,052,309 | A | | 10/1991 | Haselwander et al. | |
| 5,131,201 | A | | 7/1992 | Larson et al. | |
| 5,279,093 | A | * | 1/1994 | Mead | 52/834 |
| 5,317,854 | A | | 6/1994 | Yoshida et al. | |
| 5,373,675 | A | | 12/1994 | Ellison, Jr. | |
| 5,671,573 | A | * | 9/1997 | Tadros et al. | 52/223.8 |
| 5,678,373 | A | | 10/1997 | Franklin et al. | |
| 5,884,442 | A | | 3/1999 | Breault | |
| 5,924,254 | A | | 7/1999 | Franklin et al. | |
| 5,978,997 | A | * | 11/1999 | Grossman | 14/73 |
| 6,094,878 | A | | 8/2000 | Schluter | |
| 6,668,412 | B1 | | 12/2003 | Tadros et al. | |
| 6,668,507 | B2 | | 12/2003 | Blanchet | |
| 6,708,362 | B1 | * | 3/2004 | Allen | 14/73 |
| 6,709,192 | B2 | * | 3/2004 | Smith | 404/47 |
| 6,898,908 | B2 | | 5/2005 | Messenger et al. | |
| 6,915,615 | B2 | * | 7/2005 | Won | 52/223.6 |
| 7,010,890 | B2 | * | 3/2006 | DeSutter | 52/223.8 |
| 7,275,348 | B2 | * | 10/2007 | Desutter | 52/223.8 |
| 2003/0093961 | A1 | * | 5/2003 | Grossman | 52/250 |
| 2003/0182883 | A1 | * | 10/2003 | Won | 52/223.8 |
| 2006/0059835 | A1 | | 3/2006 | Werner | |
| 2006/0272267 | A1 | * | 12/2006 | Mentado-Duran | 52/693 |
| 2009/0100794 | A1 | * | 4/2009 | Holmes et al. | 52/831 |

FOREIGN PATENT DOCUMENTS

| | | | | |
|---|---|---|---|---|
| EP | 0011555 | A1 | | 5/1980 |
| FR | 922480 | A | | 6/1947 |
| GB | 1322754 | A | | 7/1973 |
| JP | 2010-265689 | | * | 11/2010 |
| WO | 02090660 | A1 | | 11/2002 |

OTHER PUBLICATIONS

Written Opinion dated Jul. 30, 2010 from PCT Application No. PCT/US09/064451 filed Nov. 13, 2009 (7 pages).

Office Action dated Oct. 28, 2011 from U.S. Appl. No. 12/773,714, filed May 4, 2010 (12 pages).

* cited by examiner

PRECAST COMPOSITE STRUCTURAL FLOOR SYSTEM

PRIORITY

The present application claims the benefit of U.S. Provisional Application Ser. No. 61/053,147, filed May 14, 2008, which is herein incorporated by reference in its entirety.

THE FIELD OF THE INVENTION

The present invention relates to precast composite floor systems. More specifically, the present invention relates to a precast composite floor which provides decreased weight, is able to bolt directly into a steel frame structure, and which allows for forming holes through the floor slab without concern for tensioning strands as well as the passage of mechanical equipment through the vertical stem wall of the floor section.

BACKGROUND

Precast concrete construction is often used for commercial and industrial buildings, as well as some larger residential buildings such as apartment complexes. Precast construction has several advantages, such as more rapid erection of a building, good quality control, and allowing a majority of the building structural members to be precast. Conventional precast structures, however, suffer from several disadvantages such as being heavy, requiring more material, and requiring more difficult connections between precast members and to the rest of the building structure.

Currently, precast single tee and double tee panels are used for constructing floors. The precast single and double tees are typically eight feet wide and often between 25 and 40 feet long or longer. The single tee sections typically have a deck surface of about 1.5 to 2 inches thick and a concrete beam extending down from the deck surface along the longitudinal center of the deck. The beam is usually about 8 inches thick and about 24 inches tall.

Double tee panels usually have a deck surface which is about 2 inches thick and have two beams extending down from the deck. The beams are placed about four feet apart running down the length of the panel, and are about 6 inches thick and 24 inches tall. Often, the single and double tee panels are installed and about 2 or 3 inches of concrete topping is placed on top of the panels.

Single and double tee panels have several drawbacks. These precast floor panels are heavy. Heavy floor panels require heavier columns and beams to support the floor panels and so on, increasing the weight of nearly every part of the building structure. Heavier structural elements use more materials and are thus more expensive, require increased lateral and vertical support, and may limit the height of the building for a particular soil load bearing capacity.

Another drawback of the conventional precast floor systems is that mechanical equipment and ducts must be suspended beneath the beams, increasing the vertical space required for a floor.

SUMMARY OF THE INVENTION

The present invention is a precast composite floor system which is made up of composite floor panels and composite girders. The floor system is able to be fabricated in a factory, shipped to a job site, and erected in a manner that is quicker and more efficient than existing systems. The present invention provides precast panels which are lighter than existing panels. Reducing the amount of material in the floor of a building reduces the overall weight of the building, which in turn allows for smaller columns, foundations, and lateral systems.

It is an object of the present invention to provide an improved precast composite concrete floor system.

According to one aspect of the invention, a floor system is provided which reduces the weight of the floor panels. Floor panels of the present invention weigh about half as much as conventional double tee floor panels. Reducing the weight of the floor panels reduces the load placed on the columns and other structural members of the building, allowing further reductions in weight. The reduction in building weight allows for the construction of taller structures and alleviates other construction limitations such as soil with poor load bearing capacity.

According to another aspect of the present invention, a floor panel is provided with openings formed in the stem wall, allowing mechanical equipment to be run through the stem wall. Placing mechanical equipment through the stem walls reduces or eliminates the need for suspending ducts or other equipment below the floor panels, reducing the vertical space necessary for the floor.

According to another aspect of the invention, a floor panel is provided which bolts into the steel structure of a building. Conventional precast floor panels are reinforced concrete members which have weld plates embedded therein. The floor panels are supported by concrete girders and columns, and the weld plates are welded to adjacent weld plates in other floor or wall members. Bolting the floor panels of the present invention to a steel structure allows for more rapid construction while requiring fewer trades to be present to install the floor panels.

According to another aspect of the invention, there are no tensioning strands in the floor deck (slab), allowing most openings through the deck to be made at any time during the construction process, and allowing holes to be cut through virtually any location in the floor slab except for directly over the beam section.

These and other aspects of the present invention are realized in a precast composite floor system as shown and described in the following figures and related description.

BRIEF DESCRIPTION OF THE DRAWINGS

Various embodiments of the present invention are shown and described in reference to the numbered drawings wherein.

Figure 1:
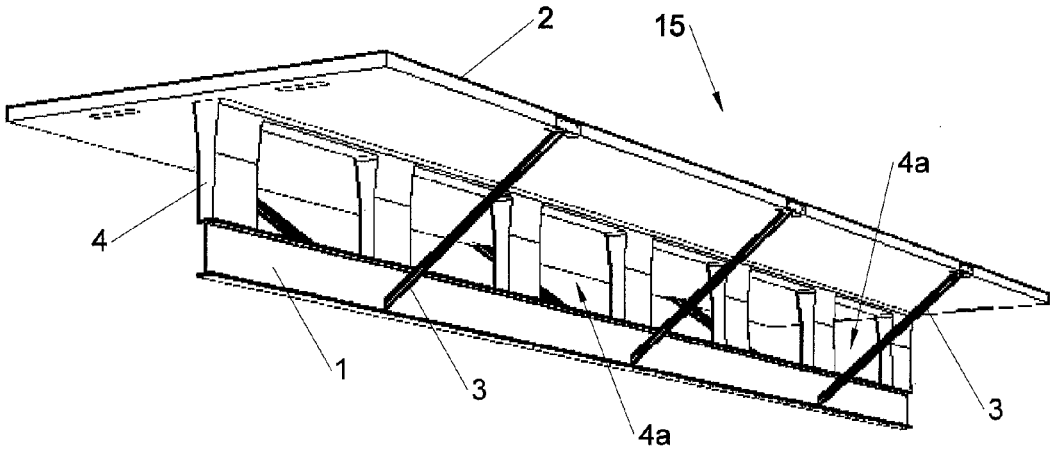
FIG. 1 is a perspective view of a finished composite panel.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single FIGURE, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

The present system has several advantages over conventional concrete double tee systems. The biggest advantage is the reduced weight. A concrete double tee system with similar spans and loading conditions would weigh approximately 100% more per square foot than the present invention. Other structural members such as concrete girders and concrete columns that are used with double tee systems are also much heavier than columns used with the present invention. Increased weight of the double tee floor system necessitates larger footings and foundation walls. This is restrictive for taller structures and for construction in areas with poor soil bearing capacity.

The vertical legs or walls of a double tee floor panel are solid and will not allow for passage of mechanical, plumbing or electrical through the Tee, thereby increasing the floor to floor dimension because all of the utilities need to be run below the floor structure. Openings in the stem wall of the present system allow the mechanical, electrical and plumbing to pass through the structure, thereby eliminating the need to run these elements below the floor structure.

The present system also allows for greater flexibility in locating slab penetrations (openings through the floor slab) because the beams are spaced farther apart, typically 8 feet on center versus 4 or 5 feet for the legs of a double tee system.

Double tee systems are assembled by weld plates embedded in each component and must bear on concrete or masonry structures. The current system is bolted into a lighter steel structure which makes it possible to use in mid to high-rise construction.

Conventional steel and concrete composite construction also has several problems which are alleviated by the present invention. Conventional composite floor framing is very labor intensive on site. After installation of the columns for a conventionally framed floor, the rest of the materials for the conventional system are installed individually, and include the girders, joists, metal deck, nelson studs, reinforcing, edge enclosures, and poured concrete. This assembly takes much longer than the present invention due to the precast nature of the present system. With the present invention, tradesmen are able to occupy the floor to complete construction in a much shorter time frame which means shortened overall construction time.

Because of the way the calculations are performed for a conventional composite floor, the concrete that is below the top of the flute in the decking is not used in the composite section, but still contributes to the weight of the concrete in the building and the cost for that material. By precasting the floor panels, the present system has eliminated the need for the metal deck. This eliminates the material and the labor required to weld the steel deck in place.

In normal steel construction, the controlling factor over the size of the steel members is the necessity of the steel framing members to carry the full weight of the wet concrete without any of the concrete strength. In the present invention, the steel beams will be completely shored by the forms while the concrete is wet. This by itself reduces the size of the steel beam and eliminates the need for precambering the beam since the beams aren't required to support the weight of the wet concrete.

Additionally, in normal steel construction the beams are aligned so that the tops of the girders and joists are flush. This is done because the metal deck is placed on the joists and girders and the deck is used as a form for the concrete slab. When calculating the section properties for this system, the distance from the top of steel beam to the middle of the concrete is one of the biggest factors. The present invention places a composite stem wall between the steel beam and the concrete deck, thereby increasing the distance from top of the steel beam to the centerline of the concrete slab. As such, the load-bearing strength and span capabilities of the precast panel system are greatly increased. The present flooring system eliminates a significant amount of steel and concrete material as compared to a conventional poured-in-place system.

In describing the composite flooring system of the present invention, multiple views of the floor panel and girder are shown, including views of the parts thereof and cross-sectional views showing the internal construction thereof. Not every structure of the panel or girder is labeled or discussed with respect to every figure for clarity, but are understood to be part of the panel or girder.

As shown in FIG. 1, the composite floor panel 15 of the present invention is made up of steel panel beam 1, a concrete slab or floor deck 2, steel braces 3, and a concrete stem wall 4. The panel is Tee shaped, with the upper horizontal portion of the Tee being the concrete slab 2. The concrete slab 2 is typically 3 inches thick and is supported by and connected to the concrete stem wall 4. The stem wall 4 is connected to the steel beam, which is the lower portion of the tee, by welded studs and/or rebar. The concrete and steel together form a composite floor panel.

When a beam supported at both ends is loaded the top half of the beam is under compression while the bottom half of the beam is under tension. Concrete has high compressive strength but low tensile strength, while steel has high tensile and compressive strength. In the present invention, the concrete slab at the top of the tee is under compression and the steel beam at the lower portion of the tee is under tension. The configuration of materials of the floor panel 15 utilizes the best structural properties of each material, making the panel more efficient.

The stem wall 4, for the majority of the span of the floor, can have large openings 4*a*, or blockouts. Preferably, 50 percent of the thickness of the floor deck 2 is retained at the top of the stem wall 4, leaving a small ridge as is visible in FIG. 1. One advantage to putting in these holes is that it reduces the amount of concrete needed which in turn reduces the dead load of the panels. Because of the methods used for designing composite beams, this concrete adds very little strength to the section, and is only necessary to transfer shear loads between the slab and the steel beam. The amount of concrete necessary to do this can be retained between the blockouts 4*a*. These holes are advantageous as they provide a convenient space to run HVAC ducts, piping and electrical conduit.

Diagonal braces 3 which are welded to the panel beam 1 and embedded weld plates in the slab 2 provide additional support for the slab. In a typical configuration, the floor slab 2 is about 8 feet wide and between 25 and 40 feet long. The concrete floor deck 2 is typically about 3 inches thick. The stem wall 4 is typically between 12 and 36 inches tall. The openings 4*a* in the stem wall 4 are typically located adjacent the stem wall, and may occupy the entire height of the stem wall if necessary. Thus, for an exemplary 24 inch stem wall 4, the openings 4*a* may be about 24 inches wide and 24 inches tall and have approximately 12 inch pillars of concrete between the openings. The steel beam 1 is typically about 12 inches tall and between 4 and 8 inches wide.

Figure 2:
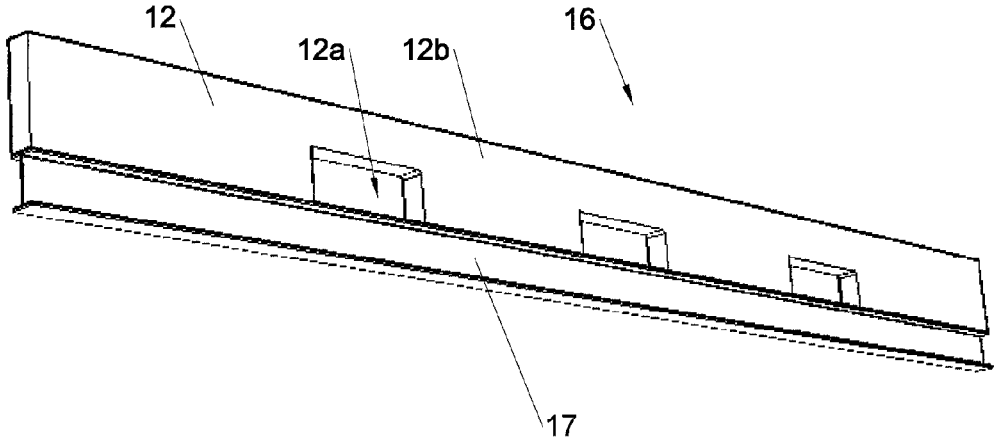
FIG. 2 is a perspective view of a finished composite girder.
Figure 3:
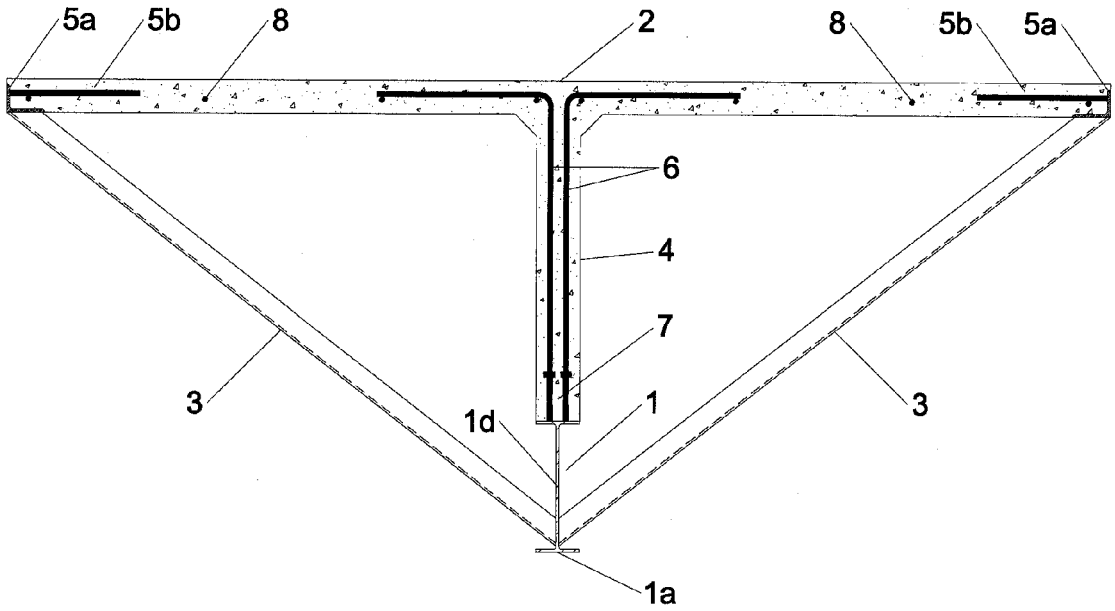
FIG. 3 is a cross-sectional view of a composite panel.
Figure 4:
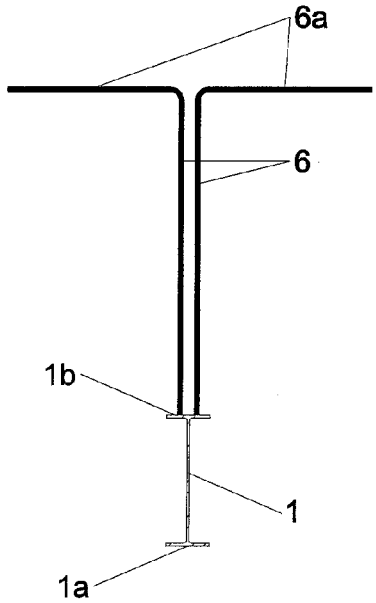
FIG. 4 is a cross-sectional view of a panel beam with attached vertical L-shaped rebar.
Figure 5:
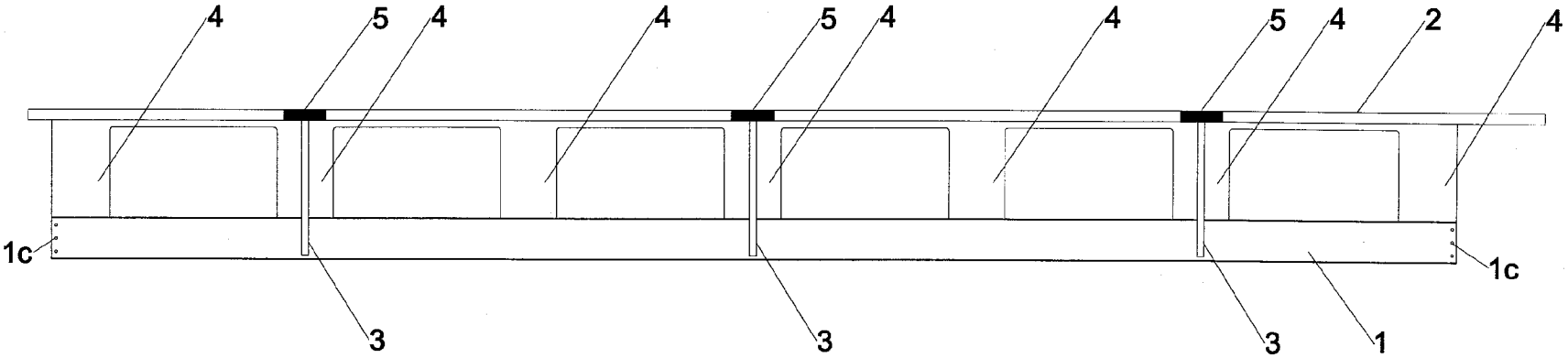
FIG. 5 is a side elevation view of a finished composite panel.
Figure 6:
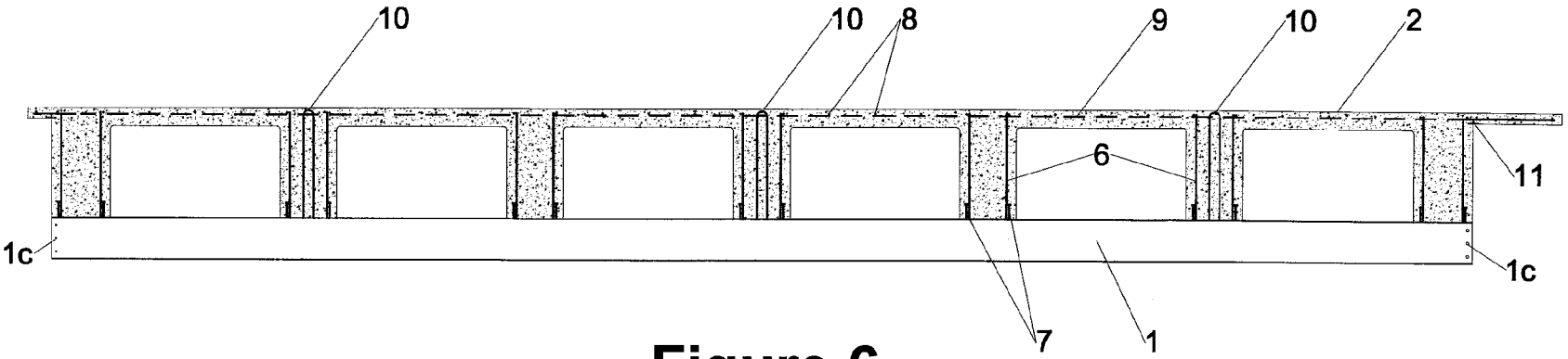
FIG. 6 is a cross-sectional side elevation view of a composite panel.
Figure 7:
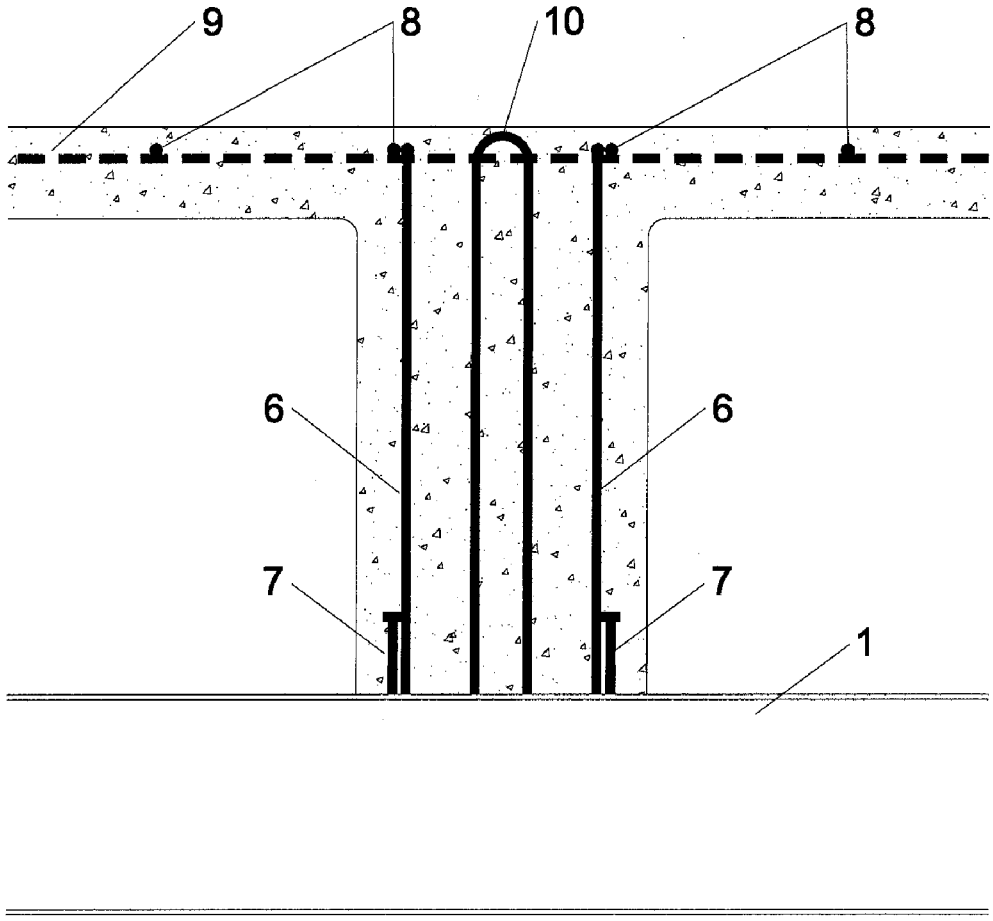
FIG. 7 is a partial cross-sectional side elevation view of a composite panel.
Figure 8:
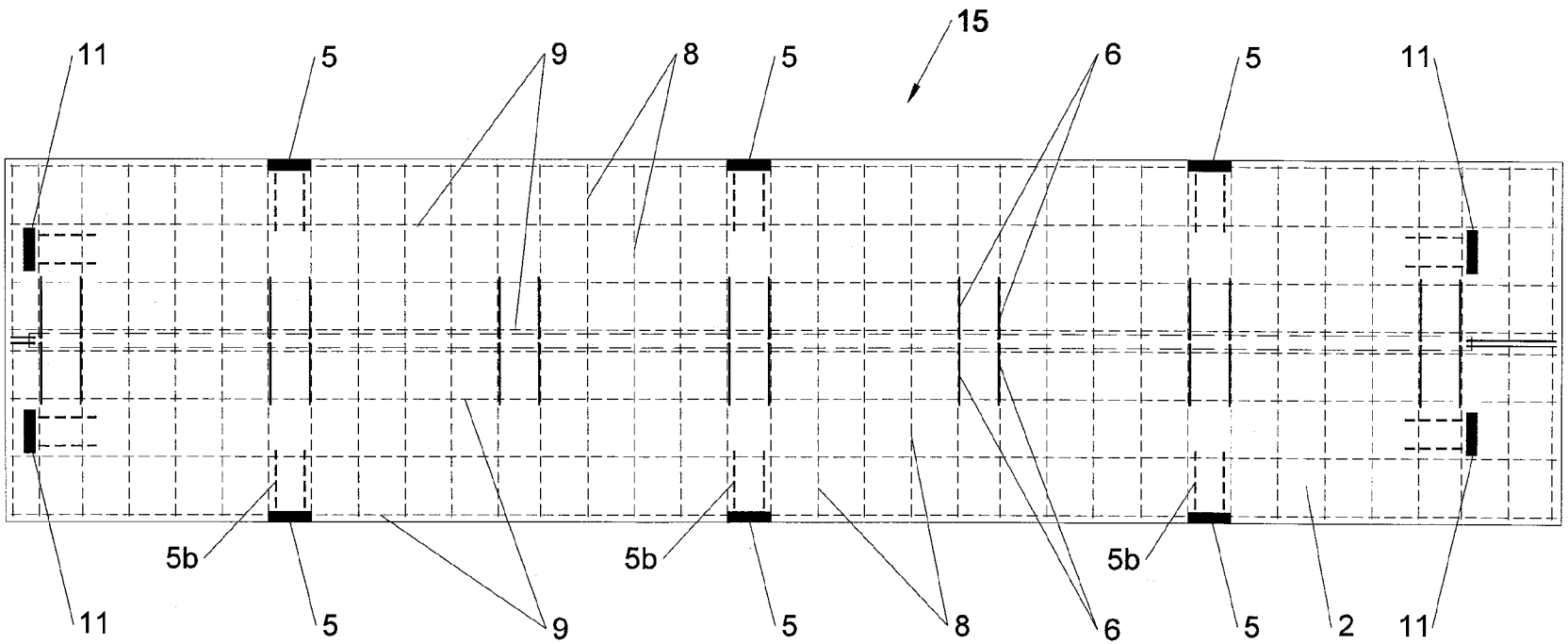
FIG. 8 is a cross-sectional plan view of a composite panel at mid-slab level.
Figure 9:
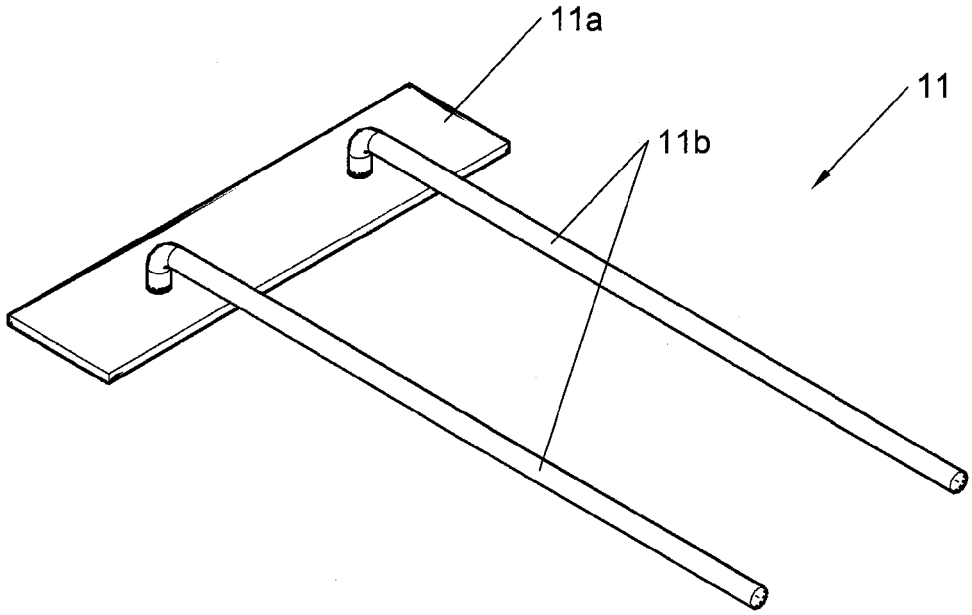
FIG. 9 is a perspective view of a typical panel end embedded weld plate.
Figure 10:
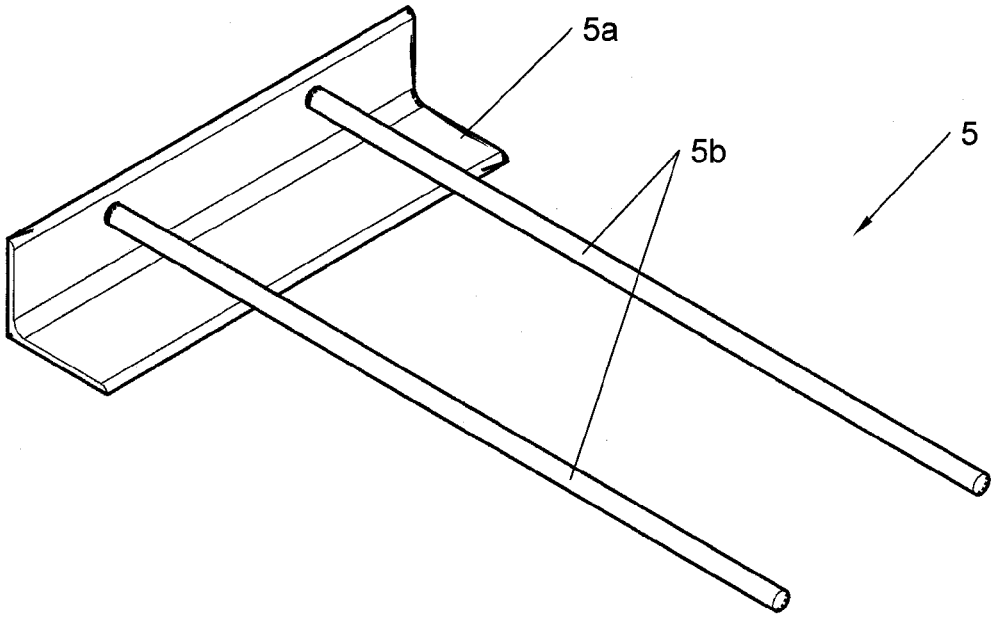
FIG. 10 is a perspective view of a typical panel edge embedded weld plate.
Figure 11:
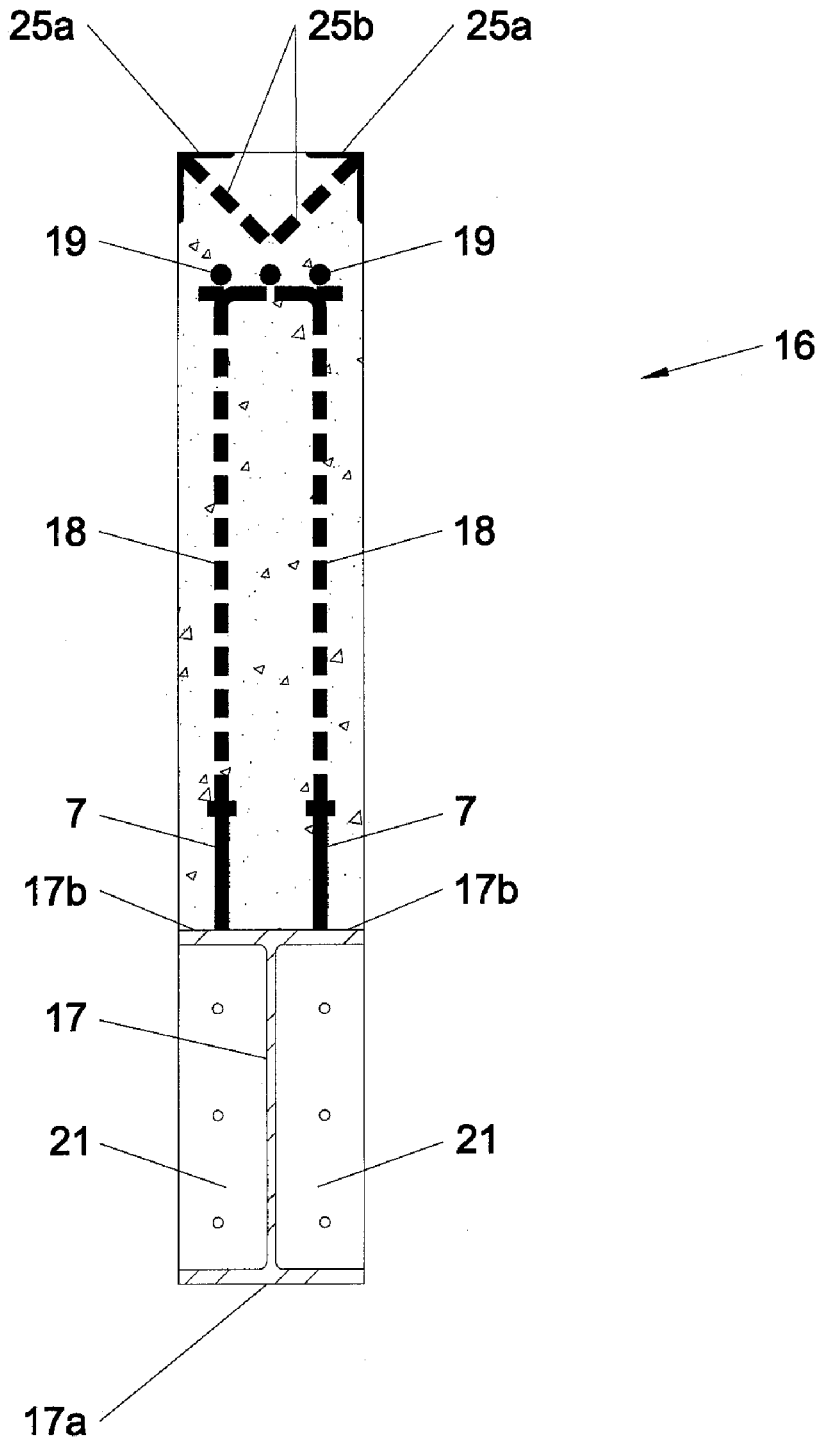
FIG. 11 is a cross-sectional view of a composite girder.
Figure 12:
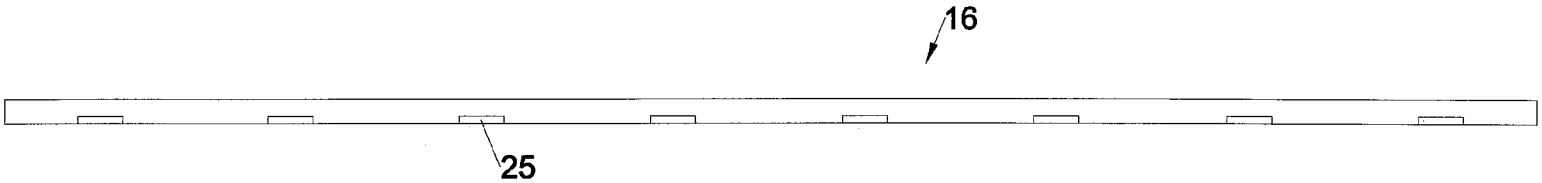
FIG. 12 is a plan view of a finished composite girder.
Figure 13:
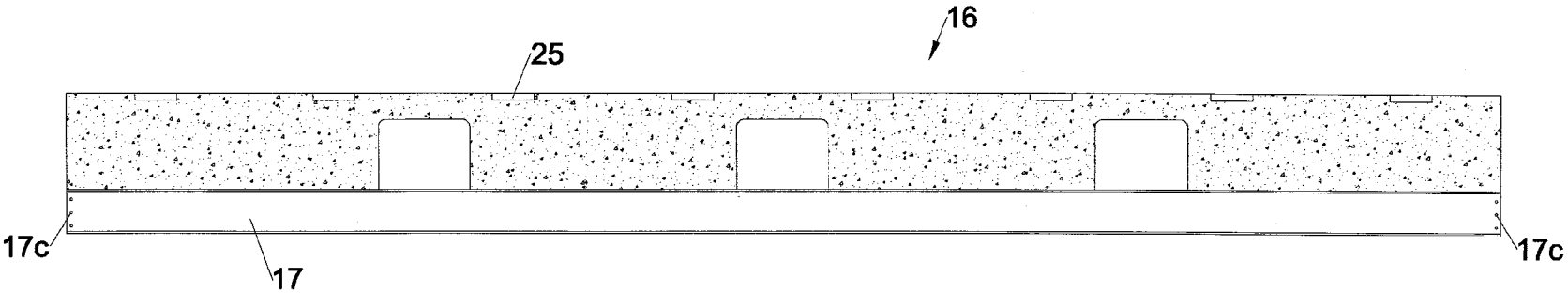
FIG. 13 is a side elevation view of a finished composite girder.
Figure 14:
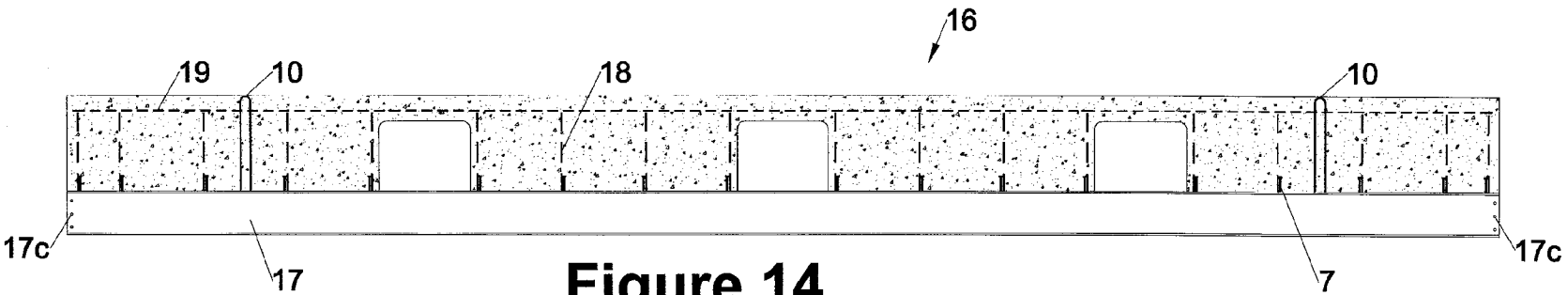
FIG. 14 is a cross-sectional side elevation view of a composite girder.

As shown in FIG. 2, a composite girder 16 for the present flooring system includes a concrete stem wall 12 and a steel wide flange beam 17. The beam 17 has rebar 18 (or another similar reinforcement) welded to the top flange of the steel beam 17. The rebar 18 extends into the stem wall 12. Shear plates are welded onto the steel girder beam and are used for connecting the panel steel beam 1 to the girder steel beam 17. The stem wall 12 includes openings 12*a* which may be used to run HVAC ducts, pipes, and electrical conduit. A sufficient amount of continuous concrete 12*b* (preferably between 50 and 33 percent of the height of the stem wall 12) is left above the openings 16*a* so as to provide sufficient compression strength to make a strong composite girder from the stem wall 16 and beam 17.

Figure 16:
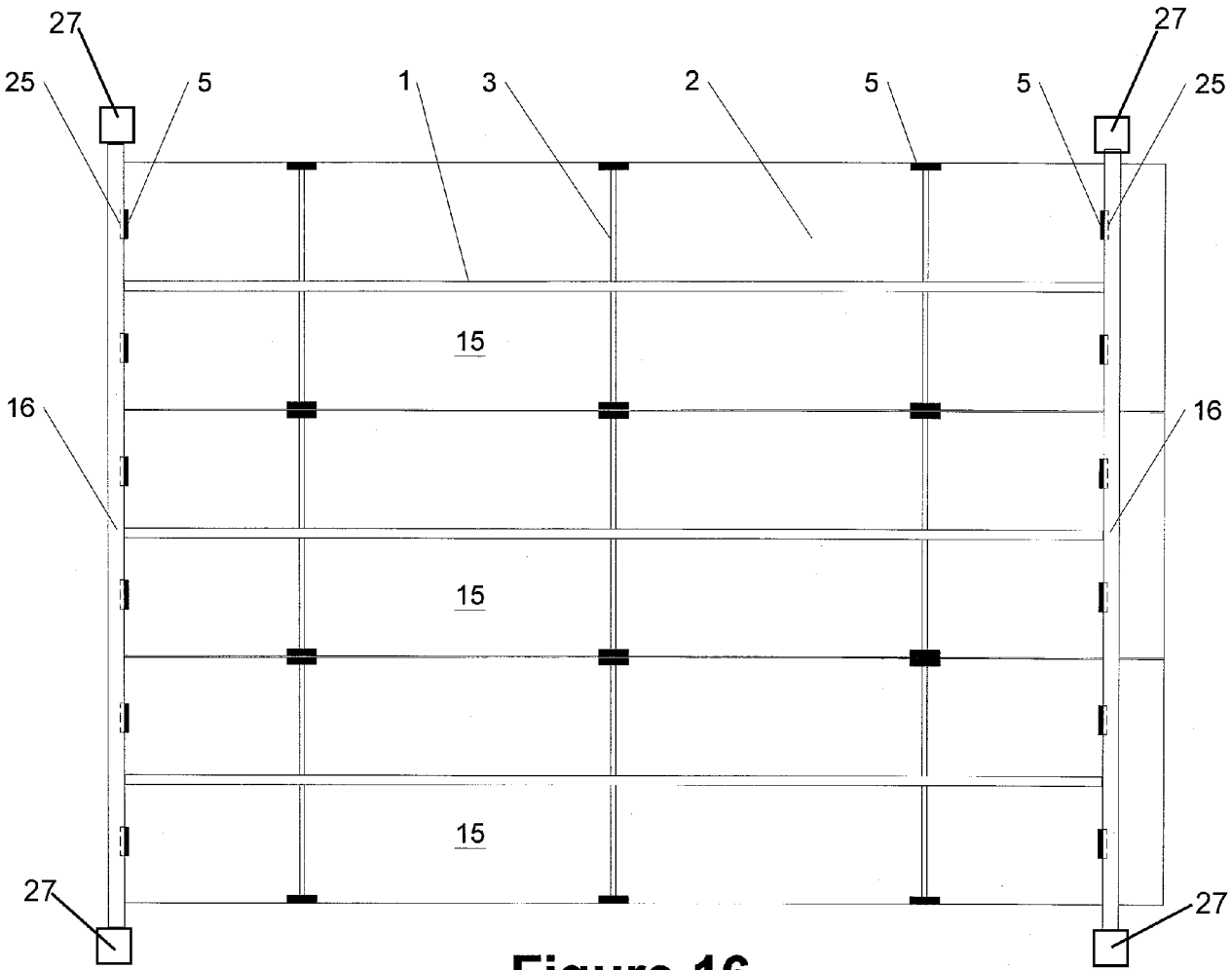
FIG. 16 is a bottom view of three panels connected to a girder at each end.

The girder 16 is typically long enough to support several floor sections as shown in FIG. 16, and as such the steel beam 17 may be about 24 feet long. The steel beam 17 is typically the same height as the steel beam 1, and is thus typically 12 inches tall and between 4 and 8 inches wide. The stem wall 12 of the girder is typically between 12 and 36 inches tall, and typically matches the height of the stem wall 4 so that the floor deck 2 rests on top of the stem wall 12 when installed. The openings 12*a* in the stem wall 12 are typically about half as tall as the stem wall, and thus may be about 12 inches tall and 24 inches wide for a 24 inch stem wall.

Panel Construction

Figure 22:
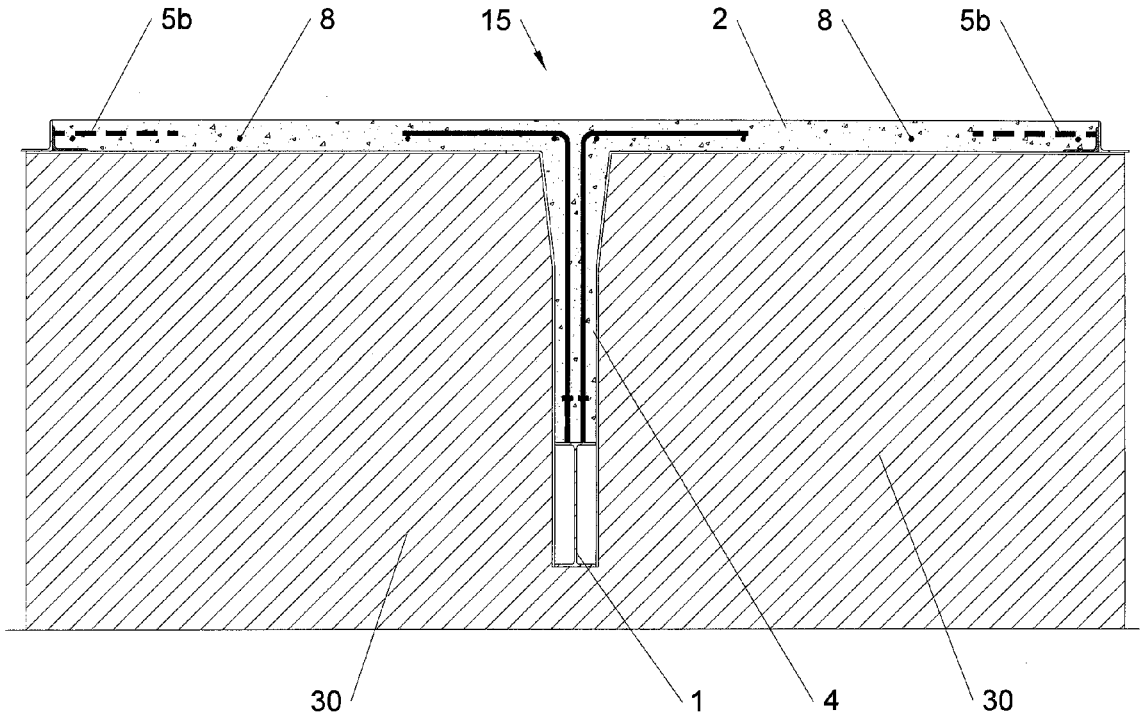
FIG. 22 is a cross sectional view of a composite panel in the casting form.

The composite panel 15 is cast in steel forms 30, as shown in FIG. 22. The structure of the forms can vary in length and width as well as construction so long as the inside shape of the form is the correct profile for the finished tee-shaped panel 15. The forms should be of sufficient strength to allow for numerous repetitive uses while maintaining the correct shape and configuration.

The structure of the floor panel 15 is illustrated in FIGS. 3-10, showing the completed panel and various parts thereof. The wide flange beam 1 for the panel 15 is cut to the appropriate length per shop drawings approved by the engineer of record. The holes 1*c* used for connecting the panel beam 1 to the girder beam 17 are then drilled into each end of the panel beam 1. The beam is then placed upright so that it is resting flush on its bottom flange 1*a*. Nelson studs 7 or similar connectors are then welded to the top side of the top flange 1*b*. Spacing of the nelson studs 7 is per approved shop drawings at intervals less than or equal to the maximum spacing allowed by prevailing building codes. Vertical L-shaped reinforcing bars 6 are then welded into place adjacent to the Nelson studs 7 which were previously welded to the top flange 1*b* of the beam. The vertical reinforcing bars 6 project upward from the top flange of the beam and then turns 90 degrees so that the short leg 6*a* of the L-shaped reinforcing bars 6 run horizontally and perpendicular to the longitudinal axis of the beam 1. The vertical reinforcing bars 6 are spaced according to the shop drawings approved by the engineer of record, typically with one vertical reinforcing bar 6 per every Nelson Stud 7.

Lifting loops 10 made from reinforcing bar which have been bent into u-shapes are welded to the top flange 1*b* of the beam at a point between the vertical reinforcing bars 6 where the concrete of the stem wall 4 will be poured to surround the lifting loops 10 and vertical reinforcing bars 6, leaving the tops of the lifting loops uncovered by concrete for lifting the panel with a crane. The length of the lifting loops 10 is approximately 0.25" less than the distance from the top side of the top flange 1*b* of the beam 1 to the top surface of the finished concrete slab 2. Lifting loops 10 are spaced at intervals determined by the overall length of the composite panel 15. Typically three lifting loops 10 are used per panel 15, with a minimum of two lifting loops on any single panel.

The beam assembly, consisting of the wide flange beam 1, lifting loops 10 and vertical L-shaped reinforcing bar 6, is then moved to a floor-mounted jig to hold it steady while the horizontal slab reinforcing rebar 8, 9 is tied to the horizontal leg 6*a* of the L-shaped vertical reinforcing bars 6. Reinforcing bars 9 running parallel to the longitudinal axis of the beam 1 are tied into place using standard tie wire to the underside of the horizontal leg 6*a* of the L-shaped reinforcing bar 6 which was welded to the beam 1. Horizontal reinforcing bars 8 running perpendicular to the longitudinal axis of the beam 1 are tied to the previously installed horizontal reinforcing bars 9 which are running parallel to the longitudinal axis of the beam 1. Reinforcing bars 8, 9 are cut to a length about two inches shorter than the overall length or width of the slab 2 in which they are to be cast. Horizontal reinforcing bars 8, 9 are typically tied with 16 gauge tie wire at all intersections.

Openings 4*a* in the concrete stem wall 4 are created by attaching a formed shape to the beam 1 between the vertical reinforcing bars 6. These openings 4*a* are typically referred to as blockouts. Blockout forms are made using a variety of materials, including but not limited to, styrene foam, rubber, wood and steel. The most common method of blockout form construction is styrene foam blocks which are secured to the beam 1 by use of tape or glue. The blockout forms are coated in form release oil or silicone to prevent it from bonding to the stem wall concrete 4 that is poured around it.

Weld plates 5, 11 are placed into the form bed and secured by tie wire or small bolts to hold the weld plates into position until the concrete has cured sufficiently. These weld plates are also referred to as embedded weld plates or simply as embeds. There are several configurations of weld plates 5, 11 used at different locations in the panel slab 2. The slab edge embed 5 consists of a short length of angle iron 5*a*, usually eight to twelve inches in length, with two straight reinforcing bars 5*b* welded to the inside of the angle 5*a* in a manner so that they extend out in the horizontal plane of the concrete slab 2 once they are placed in the forms. The weld plates 5, 11 are spaced at equal intervals along both sides of the concrete slab 2 and are used to connect adjacent panels 15 to each other at the slab 2 level.

Slab end weld plates 11 consist of short lengths of flat steel bar 11*a*, usually eight to twelve inches in length, with two L-shaped reinforcing bars 11*b* welded to one side of the flat bar and positioned so that the long leg of the L-shape will extend outward into the horizontal plane of the concrete slab 2 once they are placed in the forms. Slab end weld plates 11 are used to secure the panel slab 2 to the girder 16 below.

The beam assembly, consisting of the steel wide flange beam 1 with attached vertical reinforcing 6, the horizontal slab reinforcing 8, 9 and the stem wall blockout forms, is lifted and set into the forms which have been sprayed with form release oil. The weld plates 5, 11 have been tied or bolted to the forms and are then in contact with the horizontal reinforcing rebar 8, 9 and all bars of the weld plates 5, 11 are then tied with 16 gauge tie wire to intersecting reinforcing bars at each intersection.

Rebar chairs may be placed under the horizontal reinforcing 9 to maintain the minimum distance between the bottom surface 2*a* of the concrete slab 2 and the underside of the horizontal reinforcing 9. Rebar chairs are spaced as needed, as determined by visual inspection once the beam assembly has been set in place and all weld plates 5, 11 have been tied securely to the horizontal reinforcing 8, 9.

Concrete is placed in the forms in a manner to ensure that all reinforcing bar 8, 9 is sufficiently covered. The upper surface of the concrete slab 2*b* is finished to industry standards for concrete floors. Typically the panels 15 are covered by plastic or concrete blankets and heated air is introduced under the forms to accelerate curing of the concrete. Once the concrete has cured sufficiently the panel 15 is lifted out of the forms by the lifting loops 10 attached to the beam 1. The panel 15 is set on a flat, level surface and is held level by blocking, stands or other means acceptable to hold it level without putting excessive stresses on any one point in the panel 15.

Braces 3 are then welded to the underside of the slab at the slab edge weld plates 5 and run diagonally down to intersect with the vertical web id of the wide flange panel beam 1. The brace 3 is welded to the beam 1 and the embed 5 so that in plan view the brace is perpendicular to the longitudinal axis of the panel beam 1. One brace 3 is attached at each slab edge embed 5.

The blockout forms are removed from the beam assembly leaving voids in the concrete stem wall 4. All bolts or tie wire which were used to secure the weld plates 5,11 in place before the concrete was formed and which are projecting from the concrete slab 2 are cut off flush with the bottom surface of the concrete slab 2*a*.

Girder Construction

Figure 23:
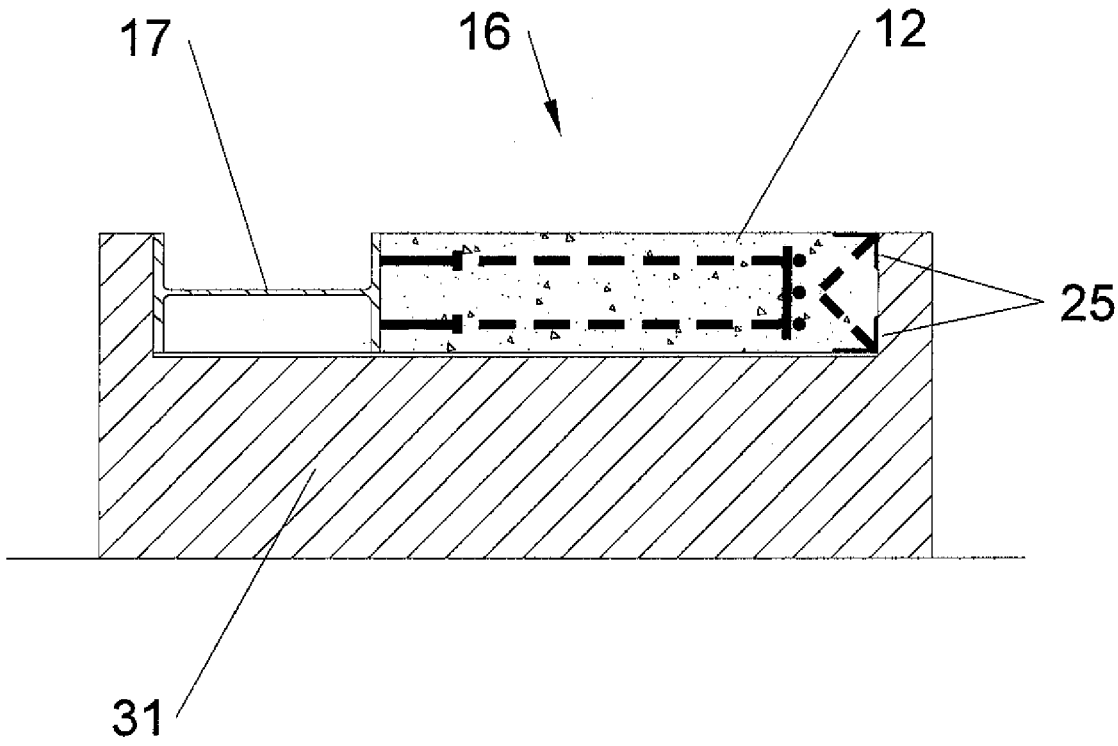
FIG. 23 is a cross sectional view of a composite girder in the casting form.

As shown in FIG. 23, the composite girder 16 is cast in steel forms 31. The structure of the forms can vary so long as the inside shape of the form is the correct profile for the finished composite girder 16. The forms should be of sufficient strength to allow for numerous repetitive uses while maintaining the correct shape and configuration.

FIGS. 11-15 show the various parts of the girder 16. The wide flange beam 17 for the girder 16 is cut to the appropriate length per shop drawings approved by the engineer of record. The holes 17*c* used for connecting the girder beam 17 to columns are then drilled into each end of the beam. The beam 17 is then stood upright so that it is resting flush on its bottom flange 17*a*. Nelson studs 7 or similar connectors are then welded to the top side of the top flange 17*b*. Spacing of the nelson studs 7 is per approved shop drawings at intervals less than or equal to the maximum spacing allowed by prevailing building codes. Vertical L-shaped reinforcing bars 18 are then welded into place adjacent to the Nelson studs 7 which were previously welded to the top flange 17*b* of the beam. The vertical reinforcing bar 18 projects upward from the top flange 17*b* of the beam and then turns ninety degrees to project horizontally and perpendicular to the longitudinal axis of the beam 17. The vertical reinforcing bars 18 are spaced according to the shop drawings approved by the engineer of record, typically with one vertical reinforcing bar 18 per every Nelson Stud 7.

Lifting loops 10, made from reinforcing bar which has been bent into a u-shape, are welded to the top flange 17*b* of the beam. The length of the lifting loops 10 is approximately 0.25" less than the distance from the top side of the top flange 17*b* of the beam to the top surface of the girder stem wall. Lifting loops 10 are spaced at intervals determined by the overall length of the composite girder 16. A minimum of two lifting loops 10 are used on any single girder 16.

The beam assembly, consisting of the wide flange beam 17, lifting loops 10 and vertical L-shaped reinforcing bar 18, is then moved to a floor-mounted jig to hold it steady while the horizontal reinforcing 19 is tied to the horizontal leg of the L-shaped vertical reinforcing bars 18 which have been welded to the beam 17. Reinforcing bars 19 running parallel to the longitudinal axis of the beam 17 are tied into place using 16 gauge tie wire to the top side of the horizontal leg 18*a* of the L-shaped reinforcing bar 18 which was welded to the beam 17.

Blockouts or openings 12*a* in the concrete of the girder 16 are created by attaching a formed shape to the beam 17 between the vertical reinforcing bars 18 which were welded to the beam 17. The blockouts 12*a* in a girder 16 are formed in the same manner as the blockouts in a panel stem wall 4.

Figure 15:
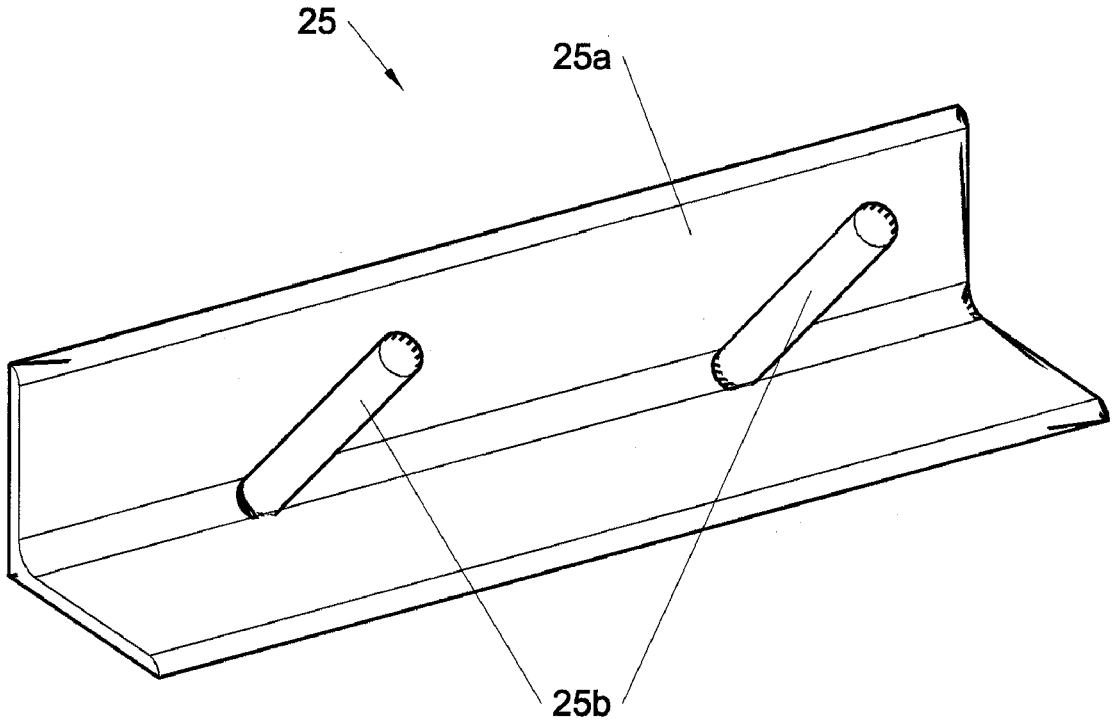
FIG. 15 is a perspective view of a typical girder embedded weld plate.

The girder beam assembly is placed into the forms 31 on its side (although they could also be poured vertically. Rebar chairs 14 are used as necessary to keep the rebar 19 away from the form bed. Weld plates 25 (as shown in FIG. 15) are placed in the form at the desired intervals, and are typically secured to the forms as discussed above with respect to the floor panels 15. Concrete is placed in the forms in a manner to ensure that all reinforcing bar 19 is sufficiently covered, typically leaving the tops of the lifting hoops 10 not covered in concrete. The side of the concrete girder 16 which is now in the horizontal position is finished to industry standards for concrete floors. The girders 16 are covered by plastic or concrete blankets and heated air is introduced under the forms to accelerate curing of the concrete. Once the concrete has cured sufficiently the girder 16 is lifted out of the forms by the lifting loops 10 attached to the beam 17.

Floor Assembly

FIGS. 16 through 20 show a floor assembly and various details of the floor assembly. The girders 16 of the floor system are installed first. A girder 16 is lifted by a crane attached to the lifting loops 10 which were welded to the girder beam 17 and embedded in concrete. Girders 16 are attached to standard steel columns 27 through bolted connections at the ends of the girders, using holes 17*c*. Welded connections can be specified by the engineer of record if it is deemed necessary.

Once the girders 16 are in position, the panels 15 can be installed. A panel 15 is lifted by a crane secured to the lifting loops 10 which were welded to the panel beam 1 and embedded into the concrete of the stem wall 4. The panel 15 is set into place so that the vertical web 1*d* of the panel beam 1 is in line with the appropriate shear tab 21. The shear tabs are welded inside the girder beam 17, connecting to the top flange, bottom flange, and web as shown. A separate bolt plate 20 is attached to both the girder shear tab 21 and the panel beam 1 with bolts. The bolted connection transfers all of the gravity forces acting on the panel 15 into the girder beam 17.

Figure 17:
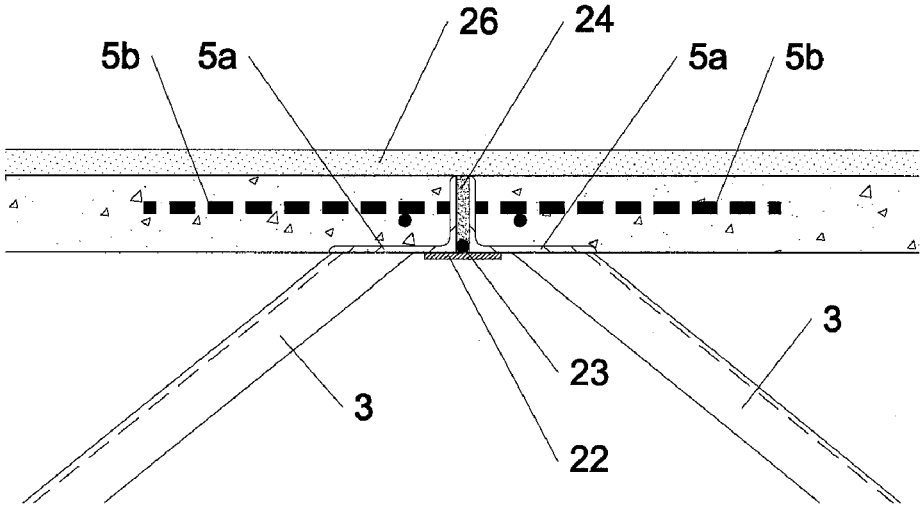
FIG. 17 is a cross-sectional view through a panel to panel connection at the slab edge weld plates.
Figure 18:
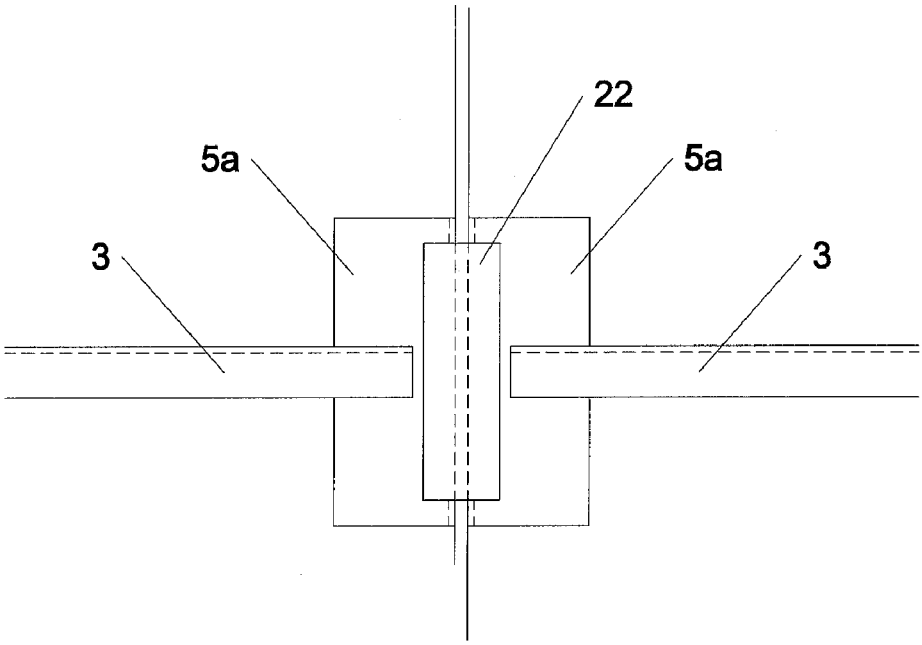
FIG. 18 is a bottom view of a panel to panel connection at the slab edge weld plates.
Figure 19:
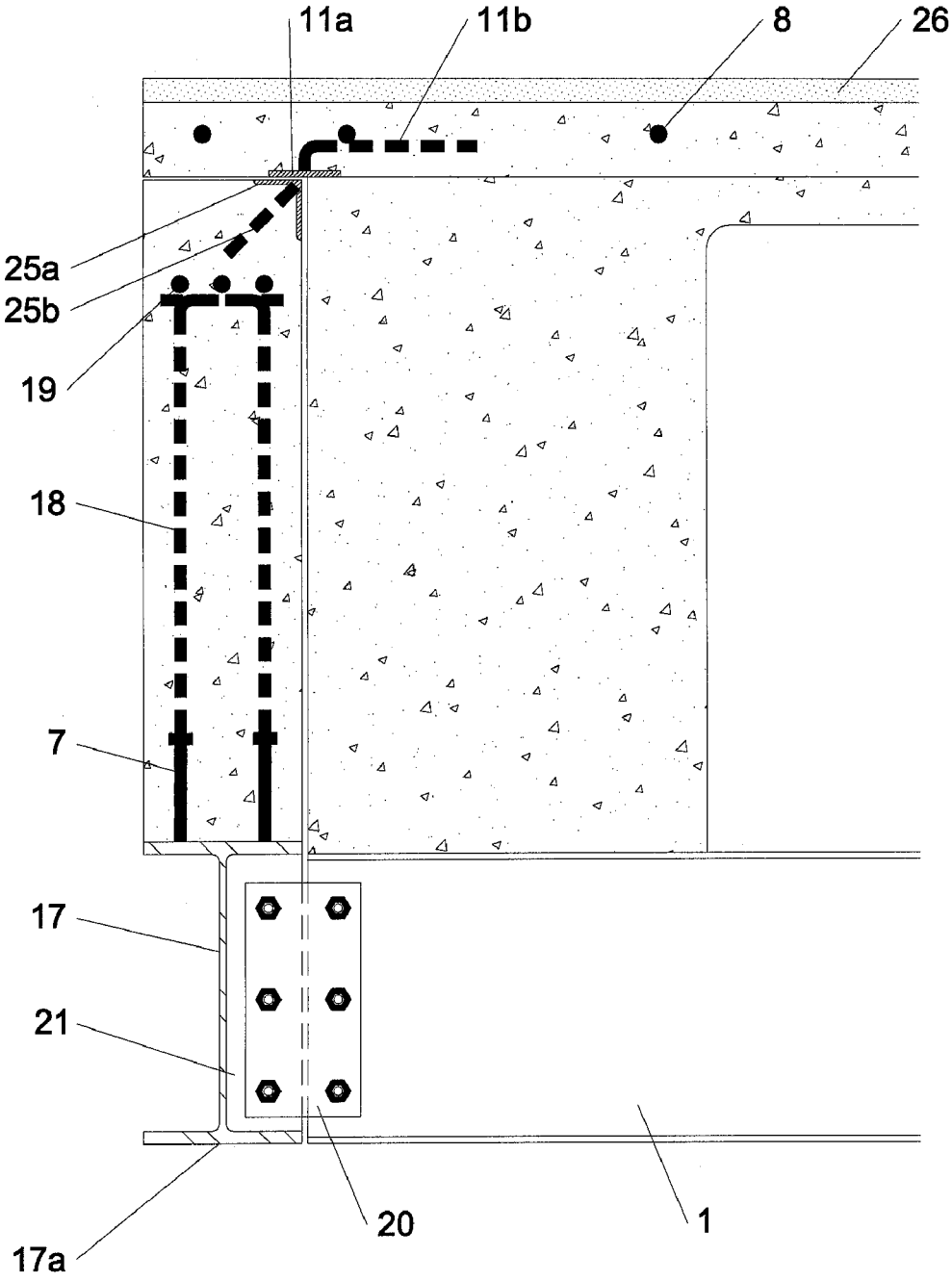
FIG. 19 is a cross-sectional view of a panel to girder connection at the centerline of the longitudinal axis of the panel.
Figure 20:
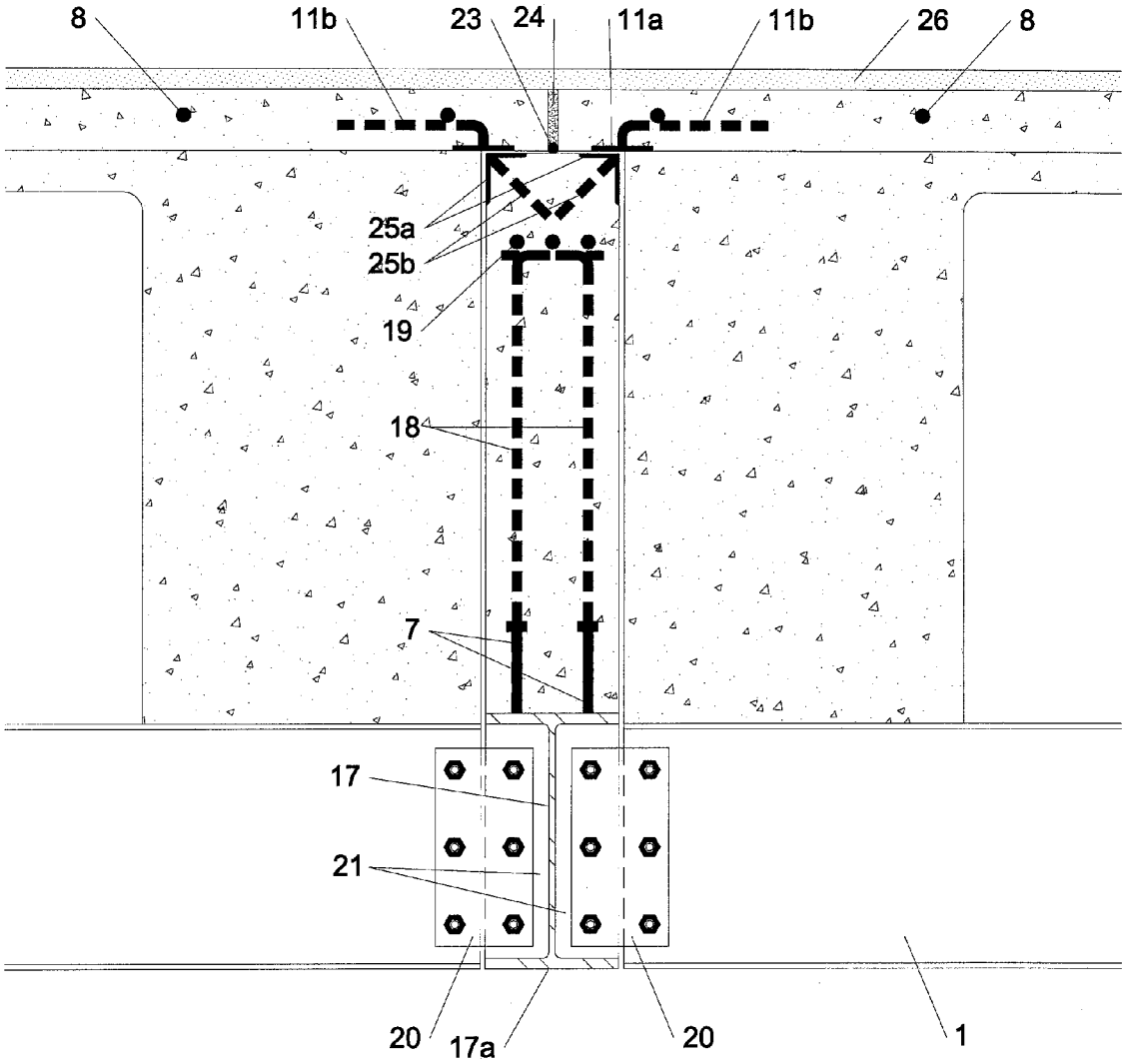
FIG. 20 is a cross-sectional view of a panel to girder connection, with panels on both sides of the girder, at the centerline of the longitudinal axis of the panels.
Figure 21:
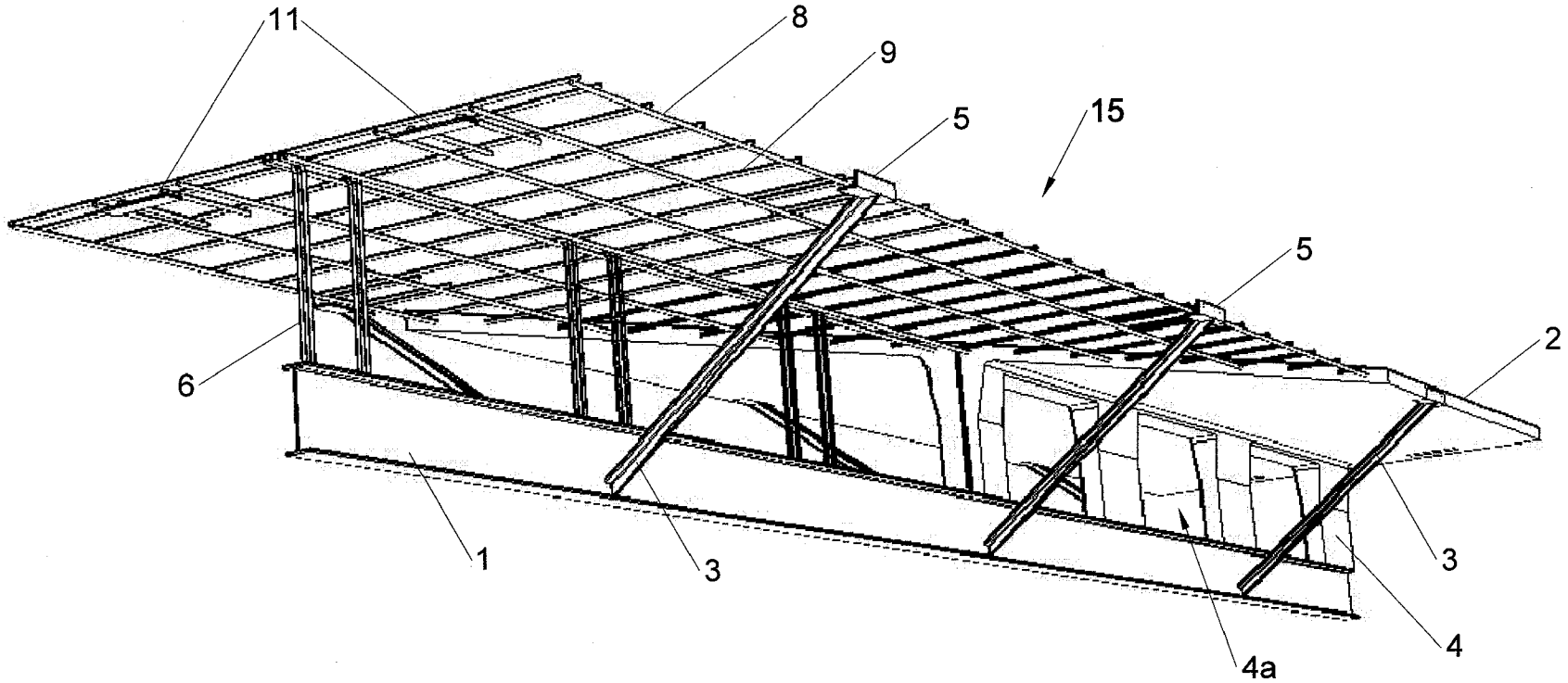
FIG. 21 is a cross-sectional perspective view of a composite panel.

Floor panels 15 are connected to each other through the embedded weld plates 5*a* at the slab edges. Lateral forces are transferred through these connections at the slab edge. As shown in FIG. 16, a flat steel bar 22 of sufficient strength is welded to the underside of two adjacent weld plates 5 to bridge the weld plates. The minimum amount of weld is typically specified by the engineer of record on the project. As is seen in FIG. 17, Panels 15 are typically placed with a small gap between the edges of the concrete slab 2. Foam backer rod 23 is inserted into the gap and the remainder of the void is filled with non-shrink grout 24.

The underside of the panel slab 2 is attached to the top of the girder 16 by welding the embedded weld plate 11 in the bottom of the slab 2 to the embed weld plate 25 in the top of the girder 16. Once all of the floor panels 15 are in place and all joints have been filled with grout 24 a lightweight topping of concrete 26 is often poured over the floor slabs 2 to provide the final wear surface and level out any variations in the slab elevations.

There is thus disclosed an improved precast composite flooring system. It will be appreciated that numerous changes may be made to the present invention without departing from the scope of the claims.

What is claimed is:

1. A precast floor system comprising a floor panel, the floor panel comprising:
- a concrete floor deck;
- a stem wall extending downwardly from the floor deck;
- a metal beam attached to the bottom of the stem wall, the metal beam extending parallel to the floor deck along the length of the floor deck; and
- braces extending from the metal beam outwardly and upwardly to the sides of the floor deck.

2. The floor system of claim 1, wherein the stem wall extends along the longitudinal center of the floor deck.

3. The floor system of claim 1, wherein the stem wall has openings formed therein.

4. The floor system of claim 3, wherein the openings occupy approximately two thirds of the stem wall.

5. The floor system of claim 3, wherein the openings extend across the majority of the height of the stem wall and are similar in height and width.

6. The floor system of claim 1, wherein the floor deck has metal weld plates embedded into the surface of the floor deck adjacent the edges thereof.

7. The floor system of claim 1, wherein the metal beam has holes in the ends thereof for bolting the metal beam to a metal girder or column.

8. The floor system of claim 1, wherein the floor deck does not include steel tensioning strands.

9. The floor system of claim 1, further comprising steel reinforcing attached to the metal beam and extending throughout the stem wall and floor deck.

10. The floor system of claim 1, further comprising a girder beam attached to the floor panel, the girder beam comprising:
- a concrete stem wall; and
- a metal beam attached to the bottom of the concrete stem wall.

11. The floor system of claim 10, wherein the girder beam concrete stem wall has openings formed therethrough, the openings being located adjacent the metal beam.

12. The floor system of claim 11, wherein the openings extend across approximately half of the height of the stem wall and have a width similar to their height.

13. The floor system of claim 10, wherein the height of the girder beam concrete stem wall is approximately the same as the height of the floor panel stem wall, and wherein the end of the floor panel metal beam is bolted to the girder metal beam, and wherein the floor panel has weld plates embedded in the bottom thereof and located adjacent weld plates embedded in the top of the girder stem wall, and wherein the floor panel weld plates and the girder weld plates are welded together.

14. The floor system of claim 13, wherein the girder beam metal beam is bolted to steel columns of a building.

15. A precast floor system comprising:
- a composite floor section comprising:
  - a reinforced concrete floor deck;
  - a stem wall extending downwardly from the bottom of the floor deck, the stem wall extending longitudinally along the length of the floor deck; and
  - a metal beam attached to the bottom of the stem wall; and
- wherein the floor deck has weld plates embedded along the edges of the deck for attaching the edges of the deck to adjacent structures and holes formed in the ends of the metal beam for bolting the metal beam to adjacent metal beams.

16. The floor system of claim 15, further comprising:
- a composite girder beam comprising:
  - a reinforced concrete stem wall; and
  - a metal beam attached to the bottom of the stem wall; and
- wherein the girder metal beam has shear tabs attached perpendicularly thereto, the shear tabs having holes formed therethrough;
- wherein the floor metal beam has holes formed in the end thereof; and
- wherein the floor metal beam end is bolted to the shear tab.

17. The floor system of claim 16, wherein:
- the floor deck has weld plates embedded in the end thereof;
- the girder beam concrete stem wall has weld plates embedded in the top thereof;
- the floor deck rests on the girder stem wall such that the floor deck weld plates are adjacent the stem wall weld plates; and
- the floor deck weld plates are welded to the stem wall weld plates.

18. The floor system of claim 15, wherein the floor section stem wall is formed from reinforced concrete, and wherein the floor section stem wall has a plurality of openings formed therethrough.

19. A precast floor system comprising:
- first and second steel columns formed as part of a building;
- a composite girder extending between the first and second columns, the girder comprising:
  - a metal beam; and
  - a reinforced concrete stem wall attached to the top of the metal beam and extending upwardly therefrom;
- a first composite floor section comprising:
  - a reinforced concrete floor deck;
  - a stem wall extending downwardly from the bottom of the floor deck; and a metal beam extending along the bottom of the stem wall; and wherein the ends of the girder metal beam are bolted to the first and second columns;

wherein an end of the floor section metal beam is bolted to the girder metal beam; and wherein the bottom of the floor deck rests on the top of the girder stem wall.

20. The floor system of claim 19, wherein the girder stem wall has weld plates embedded in the top thereof, wherein the floor deck has weld plates embedded on the bottom thereof; and wherein the girder weld plates are welded to the floor deck weld plates.

21. The floor system of claim 19, wherein the floor section stem wall has openings formed therethrough and wherein the girder stem wall has openings formed therethrough.

22. The floor system of claim 20, further comprising:

a second composite floor section comprising:

a reinforced concrete floor deck;

a stem wall extending downwardly from the bottom of the floor deck; and a metal beam extending along the bottom of the stem wall; and wherein and end of the second floor section metal beam is bolted to the girder metal beam such that the floor deck of the second floor section is disposed adjacent the floor deck of the first floor section; and wherein the edges of the floor decks of the first and second floor sections have weld plates embedded therein, and wherein the first floor section weld plates and second floor section weld plates are welded together.

* * * * *